US005920965A

United States Patent [19]

Kleban

[11] Patent Number: 5,920,965

[45] Date of Patent: Jul. 13, 1999

[54] CINCHING STRAP

[76] Inventor: David J. Kleban, 500 W. Lake Lansing Rd., #D27, E. Lansing, Mich. 48823

[21] Appl. No.: 08/968,269

[22] Filed: Nov. 12, 1997

Related U.S. Application Data

[51] Int. Cl.[6] ..... A44B 18/00; A44B 21/00; B65D 63/00

[52] U.S. Cl. ..... 24/265 R; 24/306

[58] Field of Search ..... 24/265 R, 265 CD, 24/265 EC, 301, 298, 302, 306, 442, 484, 182, 164, 172, 308, 309, 310, 315, 324

[56] References Cited

U.S. PATENT DOCUMENTS

| | | | |
|---|---|---|---|
| 3,835,505 | 9/1974 | Shewbridge | 24/302 X |
| 3,994,048 | 11/1976 | Rosentthal | 24/306 |
| 4,878,274 | 11/1989 | Patricy | 24/306 |
| 4,982,885 | 1/1991 | Severson et al. | 24/324 X |
| 5,046,945 | 9/1991 | McGowan | 24/306 X |
| 5,075,033 | 12/1991 | Kemper | 24/306 X |
| 5,167,050 | 12/1992 | Korsen | 24/442 X |
| 5,168,603 | 12/1992 | Reed | 24/306 X |
| 5,214,874 | 6/1993 | Faulkner | 24/306 X |
| 5,582,337 | 12/1996 | McPherson et al. | 24/306 X |
| 5,603,591 | 2/1997 | McLellan | 24/442 X |

*Primary Examiner*—James R. Brittain
*Assistant Examiner*—Robert J. Sandy
*Attorney, Agent, or Firm*—Schiff Hardin & Waite

[57] ABSTRACT

A cinching strap for retaining cord, rope, or other coiled matter is disclosed, comprising a first strap including means (such as a hook-and-loop material) for releasably retaining the first strap around the coiled matter in a coiled configuration, and a second strap fixed to one side of the first strap, the second strap including means (such as a buckle) for joining the ends of the strap and for cinching the first and second straps around the coiled matter.

8 Claims, 1 Drawing Sheet

CINCHING STRAP

BACKGROUND OF THE INVENTION

This invention relates to a cinching strap and method used to cinch any kind of coiled matter, such as cord, hose, rope, wire, cable, etc., to prevent it from tangling during storage.

The problem of tangling is familiar to homeowners, contractors, and anyone who uses any kind of cord, hose, or rope. Using an extension cord by way of example only, a cord is typically coiled into small loops in preparation for storage of the cord between times when the cord is used. After the cord has been coiled, however, the cord can become tangled unless the loops can be securely cinched together to hold them in place. Such tangling can occur after even the most careful user has coiled the cord and prepared to store until its next use.

While cinching straps presently exist to store coiled cords, these cinching straps do not sufficiently cinch the coiled cord to prevent it from tangling. For example, hook-and-loop material (i.e., Velcro®) strips have been looped around a coiled cord to cinch it in place. These strips have several major drawbacks in such an application. First, they are not easily adjusted after initial contact is made between the hook side of the strip and the loop side of the strip. Once contact is made between the two sides of the hook-and-loop material, there is no readily available manner to further tighten the cinch to prevent tangling. This leaves some room within the cinch for the individual sections of the cord to move around and become tangled with other sections of the cord. In addition, hook-and-loop material can sometimes become connected to other materials in close proximity. For example, the edges and ends of a hook-and-loop strip looped around a coiled cord can connect to work cloths, articles of clothing, and other such fabrics. Such contact can eventually ruin many fabrics as well as reduce the cinching effectiveness of the hook-and-loop material. More importantly, the hook-and-loop material can caught on any variety of objects and become disconnected. Finally, hook-and-loop material loses its effectiveness after it has frozen or gotten wet. Moisture and cold reduces the ability of the "hook" side to attach to the "loop" side. Therefore, these hook-and-loop strips have proved ineffective in many applications where they are intended to be used.

Other mechanisms used for cinching cords and such include basic nylon straps with metal or plastic buckles and plastic cord reels (and other plastic devices) intended for hanging and storing such coiled cords. These cinching straps have many of the same problems described above.

A need also has arisen to fasten a cinching strap to a cord even while the cord is not being cinched so that the cinching strap cannot be separated or lost from the cord. It is also important that the device be fastened to the cord in a way that does not interfere with the use of the cord. Finally, the fastening device must also allow the cinching strap to be easily accessed when the user of the cord desires to coil and store the cord.

Until the present invention, there has not been a satisfactory method and apparatus to keep coiled matter from tangling when attempting to either use the cord or store it until its next use.

SUMMARY OF THE INVENTION

The present invention is a cinching strap for retaining cord, rope, or other coiled matter comprising a first strap including means for releasably retaining the first strap around the coiled matter in a coiled configuration and a second strap fixed to one side of the first strap, the second strap including means for joining the ends of the strap and for cinching the first and second straps around the coiled matter.

It is an object of the invention to provide for tight cinching of a cord such that the cord cannot become tangled within the cinch.

It is an also object of the invention to provide for at least two methods of cinching a cord to create a tight cinch that does not allow a cord to become tangled within the cinch.

Still another object of the invention is to fasten a cinching strap to a single section of cord so that the cinching strap cannot become lost or separated from the cord.

Another object of the invention is allow a coiled cord cinched in the cinching strap to be hung during storage of the cord between uses of the cord.

The manner in which the present invention accomplishes these objectives will be made clear by a discussion of specific embodiments of the invention below.

DETAILED DESCRIPTION OF PREFERRED EMBODIMENTS OF THE INVENTION

Figure 1:
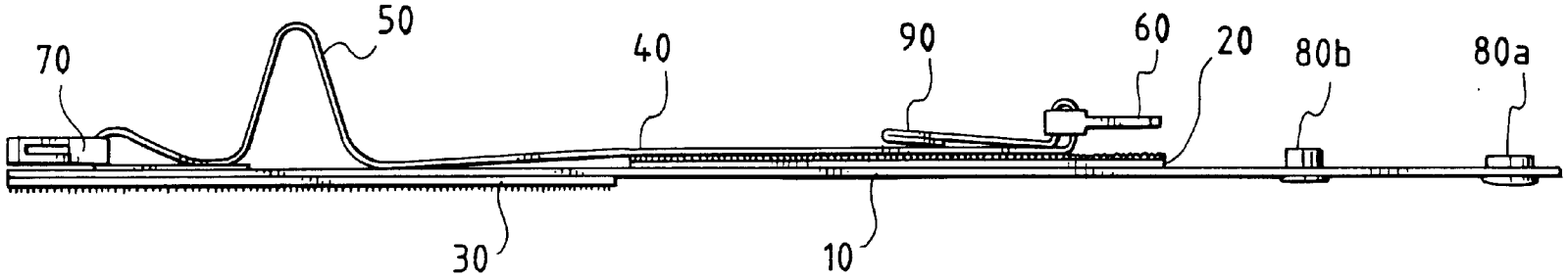
FIG. 1 is a side plan view illustrating one embodiment of the invention.

As shown in FIG. 1, the cinching strap consists of a first strap 10 made from nylon or other suitable, rugged material. The strap must be flexible enough to bend in a variety of directions and contort to a variety of shapes. The strap also must be strong enough to support the weight of the coiled matter. Attached to a first side of the strap is a first single strip 20 of hook-and-loop material. This strip can be either the "hook" side or the "loop" side. Adjacent this hook-and-loop strip 20, and attached to the second side of the strap, is a second strip of the corresponding hook or loop material 30. These hook-and-loop strips must be of sufficient length and width to attach to each other while fully encircling the coiled matter to be cinched. The function of the hook-and-loop strips is to provide an initial cinching of the strap around a section of coiled matter. As an alternative to these convenient strips 20 and 30 of hook-and-loop material, other means for releasably retaining the cinching strap around the coiled matter, such as snaps, buttons, etc., may be used to hold the cinching strap in a loop around the coiled matter.

Also attached to the first side of the strap is a smaller, second strap 40 made from nylon or other material, like the first strap 10. Like the hook-and-loop strips, the secondary strap 40 must be long enough to tightly cinch the entirety of the coiled cord. This second strap is permanently fixed to the first strap, as by sewing, adhesive, welding, or other methods. Second strap preferably includes a bowed section 50 formed by sewing or otherwise fixing the second strap to the first strap, to permit the cinched coiled matter to hang from a hook.

Integral with or joined to the second strap 40 is an adjustable joining means, such as a buckle having a male end 60 and a female end 70. Either end of the buckle is adjustable to permit the position of the buckle on second strap 40 to be altered, thereby permitting the device to be tightened around the coiled matter; in the drawing free end 90 of strap 40 is adjustable.

Figure 2:
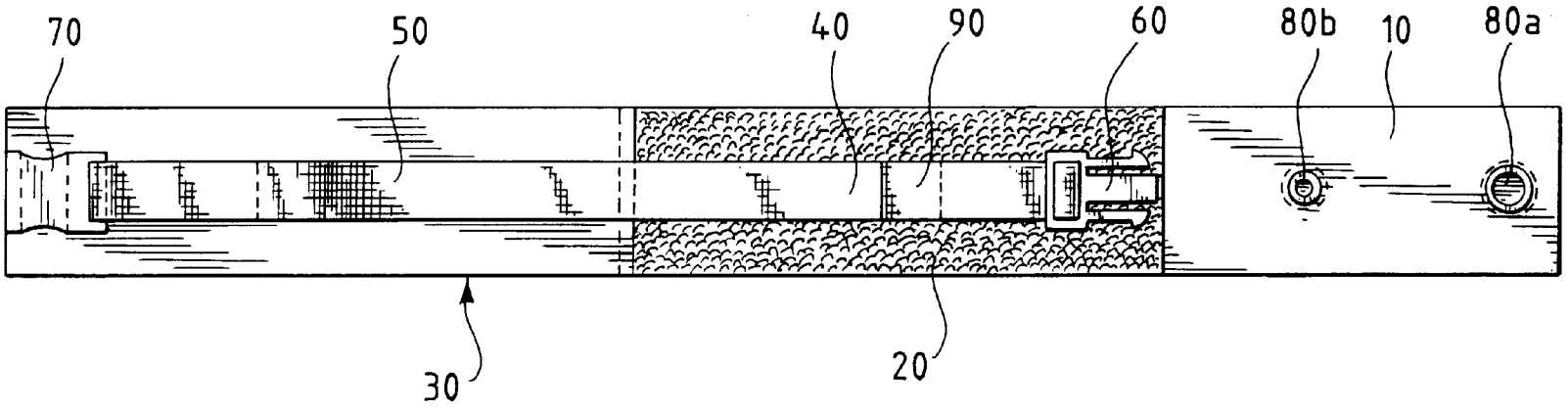
FIG. 2 is a top plan view illustrating that embodiment.

The cinching strap also preferably is equipped with means for releasably attaching the device to the coiled matter when it is in an uncoiled configuration. These means include a fastener such as a snap (as shown in FIGS. 1–2 at 80*a* and 80*b*) or button. The fastener attaches the invention to a single section of the coiled matter, to prevent the cinching strap from being lost. In the preferred embodiment, the fastener is a two-piece snap, with the male portion of the snap and the female portion of the snap spaced apart along first strap 10 to allow the strap, when the fastener is engaged, to loop around a single section of cord. The fastener also ensures easy access to the cinching strap when the coiled matter is coiled and prepared for storage.

In use, after the cord or other matter has been coiled, the first strap 10 of the cinching strap is looped around a section of the coiled matter and pulled as tight as possible around the coiled cord, the hook-and-loop strips 20 and 30 (or other similar materials) then are attached to hold the cinching strap and coiled matter is place. The two portions 60 and 70 of the buckle then are engaged, and the adjustable end of second strap 40 is adjusted to tighten the cinching strap around the coiled matter.

To further prevent the movement of the coiled matter, the first strap 10 may be prepared with a rubber or other skid-resistant coating or surface in regions where contact between the primary strap and the coiled cord occurs. The skid-resistant surface provides a greater coefficient of friction between the cinching strap and the coiled cord.

It should be understood that the invention described and claimed herein is not limited to an embodiment that incorporates all of the particular embodiments and details that have been mentioned. Indeed, the present invention has been described with respect to certain embodiments and conditions which are not meant to and should not be construed to limit the scope of the invention. Those skilled in the art will understand that variations from the embodiment and conditions described herein may be made without departing from the invention as defined in the appended claims.

What I claim is:

1. A device for retaining cord, rope, or other coiled matter comprising:

a first strap including means for releasably retaining the first strap around the coil matter in a coiled configuration;

a second strap for fixed to one face of the first strap, the second strap including means for joining the ends of the second strap and for cinching both the first and second straps around the coiled matter in approximate concentricity wherein the means for cinching both the first and second straps cinches the first and second straps at the same time.

2. The device of claim 1, wherein the means for releasably retaining the first strap comprises hook and loop material having a hook portion and a loop portion, the hook portion of such hook and loop material being disposed on one face of the first strap and the loop portion of such hook and loop material being disposed on the other face of the first strap.

3. The device of claim 2, wherein the means for joining and for cinching comprises a buckle having male and female portions, the male portion of the buckle being disposed on one end of the second strap, the female portion being disposed at the opposite end of the second strap, and one of the male or female portions being moveable along the length of the second strap to permit the first and second straps to be cinched around the coiled matter.

4. The device of claim 3, further comprising means for releasably attaching the device to the coiled matter in an uncoiled configuration.

5. The device of claim 1, further comprising means for releasably attaching the device to the coiled matter in an uncoiled configuration.

6. The device of claim 1, wherein the means for joining and for cinching comprises a buckle having male and female portions, the male portion of the buckle being disposed on one end of the second strap, the female portion being disposed at the opposite end of the second strap, and one of the male or female portions being moveable along the length of the second strap to permit the first and second straps to be cinched around the coiled matter.

7. The device of claim 1, wherein the second strap includes a bowed portion for hanging the device and coiled matter.

8. The device of claim 1, wherein the first strap has a skid-resistance surface.

* * * * *